US010934664B2

(12) United States Patent
Eberhardt et al.

(10) Patent No.: US 10,934,664 B2
(45) Date of Patent: Mar. 2, 2021

(54) METHOD AND FORMING BELT FOR PRODUCING A FIBRE MATERIAL WEB

(71) Applicant: VOITH PATENT GMBH, Heidenheim (DE)

(72) Inventors: Robert Eberhardt, Ellwangen (DE); Matthias Schmitt, Munich (DE); Frank Opletal, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 164 days.

(21) Appl. No.: 16/093,842

(22) PCT Filed: Apr. 10, 2017

(86) PCT No.: PCT/EP2017/058512

§ 371 (c)(1),
(2) Date: Oct. 15, 2018

(87) PCT Pub. No.: WO2017/178414

PCT Pub. Date: Oct. 19, 2017

(65) Prior Publication Data

US 2019/0112763 A1 Apr. 18, 2019

(30) Foreign Application Priority Data

Apr. 15, 2016 (DE) ..... 10 2016 206 387

(51) Int. Cl.
*D21F 11/00* (2006.01)
*D21F 11/14* (2006.01)
(Continued)

(52) U.S. Cl.
CPC ..... *D21F 11/006* (2013.01); *D21F 1/0036* (2013.01); *D21F 1/80* (2013.01);
(Continued)

(58) Field of Classification Search
CPC . D21F 7/08; D21F 7/083; D21F 7/086; D21F 7/12; D21F 1/0027; D21F 1/0036;
(Continued)

(56) References Cited

U.S. PATENT DOCUMENTS 3,617,442 A * 11/1971 Hurschman ..... D21F 1/0063 162/212
7,851,389 B2 12/2010 Koeckritz
(Continued)

FOREIGN PATENT DOCUMENTS

DE 102006055828 A1 5/2008
EP 2128334 A1 12/2009
(Continued)

*Primary Examiner* — Eric Hug
(74) *Attorney, Agent, or Firm* — Laurence A. Greenberg; Werner H. Sterner; Ralph E. Locher

(57) ABSTRACT

A method for producing a structured fibrous web, in particular a tissue web, includes bringing a fibrous suspension into contact with at least one structured forming belt and dewatering by using at least one dewatering element, in particular a suction element. The at least one structured forming belt includes a layer of polymer foam providing a paper-contacting side of the structured forming belt. The structure of the foam layer is at least partially transferred to the fibrous web. A structured forming belt and a machine for producing a fibrous web are also provided.

13 Claims, 2 Drawing Sheets

(51) Int. Cl.

| | |
|---|---|
| ***D21F 1/00*** | (2006.01) |
| ***D21F 7/08*** | (2006.01) |
| ***D21H 27/00*** | (2006.01) |
| ***D21F 1/80*** | (2006.01) |
| ***D21H 27/02*** | (2006.01) |

(52) U.S. Cl.
CPC ..... *D21F 7/083* (2013.01); *D21F 11/14* (2013.01); *D21H 27/002* (2013.01); *D21H 27/02* (2013.01)

(58) Field of Classification Search
CPC ..... D21F 1/0063; D21F 11/006; D21F 11/14; B32B 5/245; B32B 5/18; B32B 5/26; B32B 5/32; D21H 27/02; D21H 27/002
USPC .... 162/348, 358.2, 900, 902, 903, 116, 296, 162/351, 352; 442/221, 223, 224, 225, 442/370, 372, 373
See application file for complete search history.

(56) References Cited

U.S. PATENT DOCUMENTS

| | | | | |
|---|---|---|---|---|
| 2001/0032712 | A1* | 10/2001 | Friedbauer ..... | D21F 11/006 162/109 |
| 2004/0118546 | A1* | 6/2004 | Bakken ..... | D21F 1/0054 162/348 |
| 2011/0272112 | A1* | 11/2011 | Aberg ..... | D21F 1/0027 162/289 |
| 2012/0024486 | A1 | 2/2012 | Quigley | |
| 2017/0239912 | A1 | 8/2017 | Eberhardt | |

FOREIGN PATENT DOCUMENTS

| | | | |
|---|---|---|---|
| WO | 9527821 | A1 | 10/1995 |
| WO | 2012013773 | A1 | 2/2012 |
| WO | 2016058972 | A1 | 4/2016 |

* cited by examiner

METHOD AND FORMING BELT FOR PRODUCING A FIBRE MATERIAL WEB

BACKGROUND OF THE INVENTION

Field of the Invention

The invention relates to a method for producing a structured fibrous web, in particular a tissue web, in which a fibrous suspension is brought into contact with at least one structured forming belt and is dewatered by at least one dewatering element, in particular a suction element, and the at least one structured forming belt includes a layer of polymer foam providing a paper-contacting side of the structured forming belt. The invention also relates to a forming belt for a machine for producing a fibrous web, in particular a tissue web, including a paper-contacting side, a backing side, a support structure and at least one layer of polymer foam. The invention finally also relates to a machine for producing a fibrous web, in particular a tissue web.

In the production of a fibrous web, in particular of a tissue web, an aqueous fibrous suspension is usually dewatered on a forming screen or else between two forming screens in a so-called former in a first process step. This dewatering is typically supported by suction elements or else by blower elements.

In a conventional tissue former the fibrous web is largely formed in a planar manner. However, the volume of a tissue web, the so-called bulk, is a substantial quality characteristic. It is therefore desirable for the tissue web to be formed so as to have a highest possible bulk already in the former. To this end, the so-called ATMOS™ system was developed in the past by the applicant, for example. To this end, reference is made to the patent application WO 2012/013773 as well as to the literature cited therein, in particular the European patent application EP0 708 857. The fibrous web herein is formed on a structured screen, the so-called "molding fabric" in the former.

This structured screen has a support structure which is suitable for receiving the tensile loading that arises, and a structuring layer, the "sculpturing layer". The structuring layer by way of the weaving pattern thereof is designed such that pocket-type structures are created between the highest points of the clothing and the support structure layer. Said pocket-type structures are transferred to the fibrous web in that fibers are deposited therein the formation of the sheet, on account of which a tissue web having a noticeably higher volume is created.

However, it is disadvantageous in the prior art that the weaving of said structured screens is very complex. Moreover, the choice of structures which can be transferred to the fibrous web is also limited. By virtue of the uniform weaving process, only uniform structures can thus be generated.

SUMMARY OF THE INVENTION

The invention is based on the object of making available a method and a forming belt which entirely or partially overcomes the problems of the prior art.

This object in terms of the method is completely achieved by a method for producing a structured fibrous web, and in terms of the forming belt by a forming belt for a machine for producing a fibrous web, as described below.

A method for producing a structured fibrous web, in particular a tissue web, is proposed. A fibrous suspension herein is brought into contact with at least one structured forming belt. This can be performed, for example, in that the suspension is applied to a structured forming belt. Alternatively, it can also be provided that the suspension is incorporated between two forming belts. Either one of the two forming belts, or else both forming belts, herein can be a structured forming belt. The fibrous suspension is dewatered by means of at least one dewatering element, in particular a suction element or else a blower element. It is provided according to the invention that the at least one structured forming belt comprises a layer of polymer foam which provides the paper-contacting side of the structured forming belt, and the structure of the foam layer at least in part is transferred to the fibrous web during the forming process.

Advantageous embodiments of the method are described in the dependent claims.

In one advantageous embodiment of the method it can thus be provided that at least part of the structure of the layer of polymer foam that is transferred to the fibrous web is a pore structure of the layer of polymer foam. In this case, the pores of the layer of polymer foam that are open toward the paper-contacting side of the layer form those pocket-type structures in which the cellulosic fibers are deposited in the formation of the sheet, on account of which a tissue web having a noticeably higher volume is created. The volume-increasing effect is thus the same as in the woven structures in the prior art. However, commercially available foams, in particular soft foams, can be used for the layer of polymer foam. The complex weaving method is dispensed with. Moreover, the structures that are thus created in the web are non-uniform since the pores in the foam are distributed largely in a statistical manner. This can be advantageous to the extent that the human eye more readily perceives uniform structures and judges the latter as interfering marks. It is particularly advantageous for this embodiment for the layer of polymer foam to have a pore density of less than 45 PPI, in particular less than 30 PPI. The pores in such a case often have a size which is very advantageous for transferring the structure to the paper web.

In one further advantageous embodiment of the method it can be provided that in addition to the pore structure an external structure is incorporated in the layer of polymer foam. This structure can be incorporated in the layer of polymer foam, for example, by embossing, branding, etching, cutting, or punching. These structures can also be transferred to the sheet during the forming process. This can be performed either additionally to transferring the pore structure to the sheet. Alternatively, the method can also be designed such that said external structures mainly or exclusively are transferred to the sheet. To this end, it can be advantageous for the polymer foam to have a pore density of more than 60 PPI, in particular more than 100 PPI.

By means of the incorporated external structure it is possible for a multiplicity of structures to be transferred to the fibrous web by means of the method described. It is thus possible for special structures or symbols to be transferred in a finished paper. Watermarks or certain decorative structures in tissue papers are examples thereof. It is possible for a multiplicity of structures to be transferred to the fibrous web produced by way of such signs or structures in the foam layer, in particular by way of structures embossed in the foam layer.

The structures in the fibrous web can project as raised structures, depending on the use of such a clothing.

By means of transferring structures to the foam layer in such a manner, by contrast to classic watermarks, for example, it is possible for the clothing to continue to have a relevant permeability at the locations of the structural features. Depending on the design embodiment of the structure, said relevant permeability can optionally be somewhat higher or lower than the permeability of the remaining clothing. This can be advantageous inter alia when the structures, or the structural elements, respectively, cover a significant part, in particular more than 10%, of the surface of the material web. Dewatering of the material web is also performed through these regions of the clothing. The dewatering of the material web is thus substantially more uniform as compared to classic watermarks for forming screens in which no dewatering usually takes place in regions having a structure applied thereto.

In terms of the forming belt the object is achieved by a structured forming belt for a machine for producing a fibrous web, in particular a tissue web, wherein the structured forming belt has a paper side and a backing side, comprising a support structure and at least one layer of polymer foam, characterized in that the layer of polymer foam provides the paper side of the clothing, and the paper side of the clothing is suitable for transferring a structure to the fibrous web.

Advantageous embodiments of the structured forming belt are described in the dependent claims.

The support structure is often formed by a woven fabric or comprises the latter. However, it can also be provided that the support structure is formed by other formations, for example, by warp and/or weft knitted fabrics, cross-laid structures, foil/film structures, or membrane structures, or comprises such.

It can furthermore be provided that the external structure is a uniform or non-uniform structure.

In one particularly advantageous embodiment of the structured forming belt it can be provided that the layer of polymer foam has a pore density of less than 45 PPI, in particular less than 30 PPI. The pores in this case often have a size which is very advantageous for transferring the structure to the paper web. Polymer foams having a pore density of more than 45 PPI, in particular more than 60 PPI or 100 PPI, can also be used. Foams of this type are advantageous in particular in combination with external structures, for example when the external structure rather than the pore structure of the polymer foam is to be transferred.

In one further advantageous embodiment the layer of polymer foam by means of embossing, branding, etching, cutting, or punching, can be provided with an external structure.

For example, the structured forming belt can be provided with an external structure in that the layer of polymer foam is compacted and a hot roller which is brought into contact with the layer of polymer foam is used when compacting. Said roller can advantageously be equipped such that a structure to be transferred to the foam is incorporated as a negative in the roller surface. Said structure can be of a heat-conducting material (for example metal) or from a non-heat-conducting material such as a polymer (for example a silicone). The structure is then embossed in the surface of the foam layer during compacting. Alternatively or additionally, it is also possible for structural elements to be machined, for example engraved, into the roller surface. The structural elements after compacting then remain as raised elements in the foam layer.

A multiplicity of suitable polymer materials can be used for the layer of polymer foam. It can thus be advantageously provided that the layer of polymer foam is composed of or comprises an elastomer, in particular is composed of or comprises a polyurethane. In one other advantageous embodiment it can be provided that the layer of polymer foam is composed of or comprises a polyamide, polyester, polyethylene, or a silicone. These materials are advantageous for the forming belt, the invention is however not limited to said materials.

In one further advantageous embodiment it can be provided that the layer of polymer foam has an anisotropic pore structure. In the case of such an anisotropic structure the shape at least of a large proportion (often more than 50%, or else more than 80%) of the individual pores deviates from the isotropic spherical shape. It can thus be provided in one advantageous embodiment that the pores in the machine direction of the clothing and in the cross direction of the clothing have a larger extent than in the thickness direction. A pore structure of this type can be achieved, for example, by compressing a foam layer having an isotropic pore structure. The water can often be directed rapidly away from the paper web through such an anisotropic pore structure in the direction of the support structure. On account of said anisotropic pore structure, the foam layer usually also has a smaller available storage volume.

The connection of the layer of polymer foam to the support structure can advantageously be implemented by means of adhesive bonding or welding, in particular by means of NIR transmission welding.

The invention furthermore comprises a machine for producing a fibrous web, in particular a tissue web, in which the machine has at least one forming belt according to the invention. Such a machine is suitable for carrying out the method according to the invention and for generating a structured fibrous web.

BRIEF DESCRIPTION OF THE SEVERAL VIEWS OF THE DRAWING

The invention will be further explained hereunder by means of schematic, not-to-scale drawings in which.

DESCRIPTION OF THE INVENTION

Figure 1:
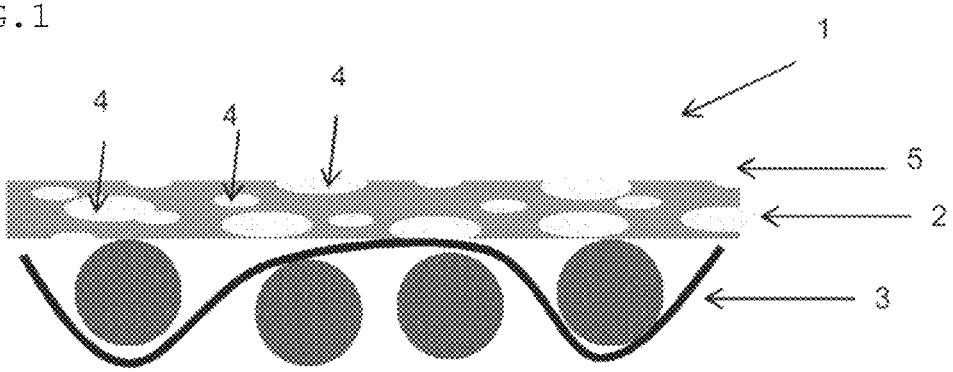
FIG. 1 shows an embodiment of a structured forming belt according to the invention.

The construction of a potential embodiment of the structured forming belt 1 is shown in FIG. 1. The structured forming belt 1 in the embodiment shown here comprises a woven fabric 3 which makes available the support structure 3. A layer of polymer foam 2 is fastened to said support structure 3. Said layer can be composed of a polyurethane soft foam, for example. Said layer of polymer foam 2 also makes available the paper-contacting side 5 of the structured forming belt 1. The pores 4 of the layer of polymer foam 2 in the clothing shown in FIG. 1 are anisotropic. This can be implemented, for example, in that a standard polymer foam which usually has isotropic pores has been compacted by way of a compacting step by means of pressure and/or temperature. On account thereof, apart from the thickness of the foam layer 2, the shape of the pores 4 is also modified. Said pores 4 are deformed in the thickness direction.

A potential production method for a structured forming belt as is shown in FIG. 1 is to be explained by way of an exemplary example. In the example, a woven support structure 3 is first made available. Said support structure 3 is woven from polyester filaments. Moreover, a foam, for example in the form of a reticulated polyurethane soft foam, is made available. Said foam in the example has a thickness of 4 mm and a pore density of 45 PPI. However, a polymer foam having a pore density of less than 45 PPI, in particular also of less than 30 PPI, can also be advantageously used.

Laser transmission welding represents a suitable method for connecting the layers of polymer foam 2 to the support structure 3. A NIR laser having a wavelength of 940 nm is used in the example. Said NIR laser was pressed thereonto at a joining pressure of approx. 20 N/cm. In laser transmission welding it is particularly advantageous for the polymer foam 2 to fully or partially absorb the laser light while the support structure 3 is fully or largely transparent to the laser light. This was achieved in the example by dying the polymer foam, an anthracite-colored foam being used herein. On account of the choice of a basic woven fabric of polyester, the laser light was able to first penetrate the support structure 3 and said laser light was thereafter absorbed by the polymer foam.

The heat required for welding was thus generated at the connection location between support structure 3 and foam layer 2. This is a principle that is usual in laser transmission welding.

The laminate thus connected was then compacted under pressure at a temperature of approx. 190° C. The resulting clothing 1 had a permeability of 400 CFM at a thickness of 1.07 mm (measured at 6 kPa pressure). The proportion of the support structure 3 in the example herein was 0.49 mm, the proportion of the foam layer 2 was 0.58 mm. At an initial thickness of the foam of 4 mm, said foam was compacted by the method to 14.5% of the initial thickness thereof.

At a pressure of 50 kPa, the laminate 1 was compressed to 0.91 mm, wherein the thickness of the foam layer 2 was 0.42 mm. At this pressure, the foam layer was thus further compressed by 27%. When releasing the pressure to 6 kPa, the foam layer expanded again to the initial thickness thereof (within the range of measuring accuracy).

Figure 2:
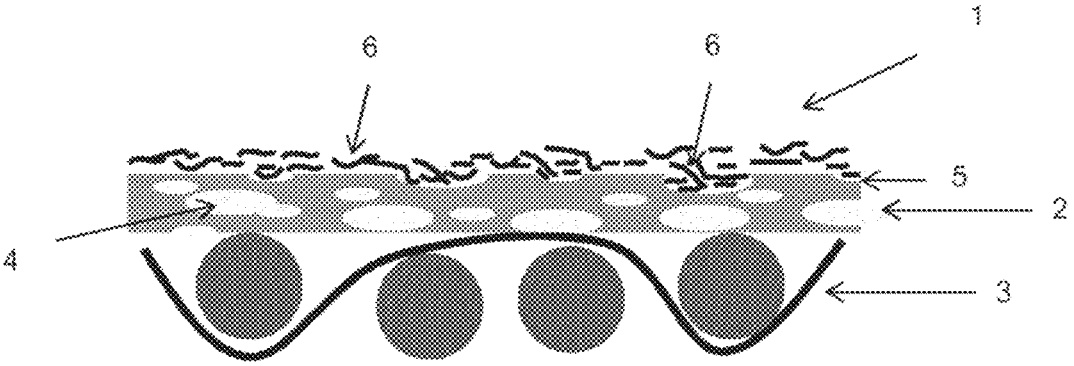
FIG. 2 schematically shows the formation of the fibrous web on the forming belt.

The formation of the fibrous web on the forming belt from FIG. 1 is schematically illustrated in FIG. 2. The process is intended to explain the creation of a structured fibrous web in an exemplary manner. A suspension having fibers 6, in particular cellulosic fibers 6, herein is applied to the structured forming belt 1. The dewatering in FIG. 2 is performed from the top to the bottom, that is to say that the water first runs through the layer of polymer foam 2 and then through the support structure 3. The dewatering process can be supported by a dewatering element (not illustrated in FIG. 2), for example a suction box, which is disposed on that side of the forming belt 1 that faces away from the paper. The fibers 6 in this process are deposited on the paper-contacting side 5 of the forming belt 1. This paper-contacting side 5 is made available by the layer of polymer foam 2. On account of the pore structure of the polymer foam 2, some of the fibers 6 by way of comparatively large pores 4 can invade the layer of polymer foam 2 and are deposited in said pores 4. In this way, the structure of the forming belt 1, in particular the pore structure of the layer of polymer foam 2, is at least in part transferred to the fibrous web. This effect of the deposition of fibers in the pore structure can be supported by an appropriate choice of the polymer foam. In general, foams having a pore density of less than 45 PPI, in particular of less than 30 PPI, can thus be advantageous. However, depending on the suitability of the fibrous material (fiber length, degree of fibrillation), foams having other pore densities can also be successfully used.

A structured fibrous web which has been produced by means of a method according to the invention can have great advantages, for example in terms of thickness and porosity, in relation to a comparable non-structured fibrous web. On account of the greater thickness, fibrous webs having a lower mass per unit area which nevertheless have all desired product characteristics can also be produced. On account of the saving in terms of fibrous material that can thus be achieved, the method is also very advantageous in economic terms.

By way of the test result hereunder it is to be illustrated as a way of example which effects can be achieved by a structured fibrous web produced according to the invention as compared to a web that is formed on a conventional SSB screen:

| Forming belt | Mass per unit area | Thickness | Density | Porosity (Bendtsen) |
|---|---|---|---|---|
| 1. SSB screen | 86.2 [g/m$^2$] | 132 [μm] | 0.653 [g/cm$^3$] | 421 [ml/min] |
| 2. Structured forming belt | 81.5 [g/m$^2$] | 149 [μm] | 0.547 [g/cm$^3$] | 955 [ml/min] |

The increased thickness at a lower mass per unit area as well as the significantly increased porosity of the structured product are particularly conspicuous herein.

Figure 3:
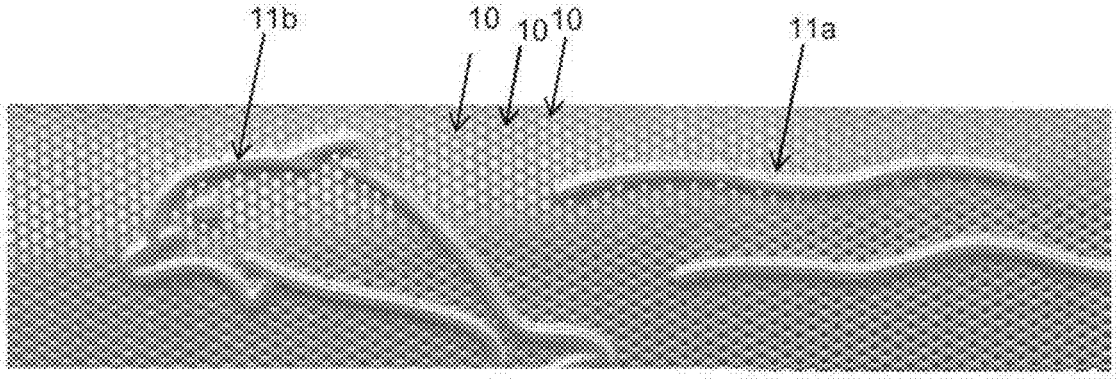
FIG. 3 shows a fragment of the surface of a roller for transferring an external structure to a layer of polymer foam.

FIG. 3 shows a fragment of the surface of a roller for transferring an external structure to a layer of polymer foam 2. The roller in the example shown here has both raised structural elements 11*a*, 11 *b* which are embossed in a layer of polymer foam 2. Moreover, the fragment in FIG. 3 has a multiplicity of structural elements 10 which are embodied as round depressions in the roller surface. These structural elements are transferred as raised elements to the foam layer 2.

In the case of the example shown in FIG. 3, both the roller surface as well as the raised structural elements 11*a*, 11*b* are embodied from metal. However, it can also be provided that said raised structural elements 11*a*, 11*b* are fully or partially composed of a non-heat-conducting material, for example of a polymer. While transferring the structural elements 10, 11*a*, 11 *b* in principle can be performed in a separate operating step prior to or subsequent to the production of the clothing on the polymer foam 2 by means of such a or similar roller, the transfer is however often advantageously performed conjointly with compacting the foam layer. In this way, one process step in the production of the clothing can be dispensed with. Moreover, no additional devices are required for this transfer.

Figure 4:
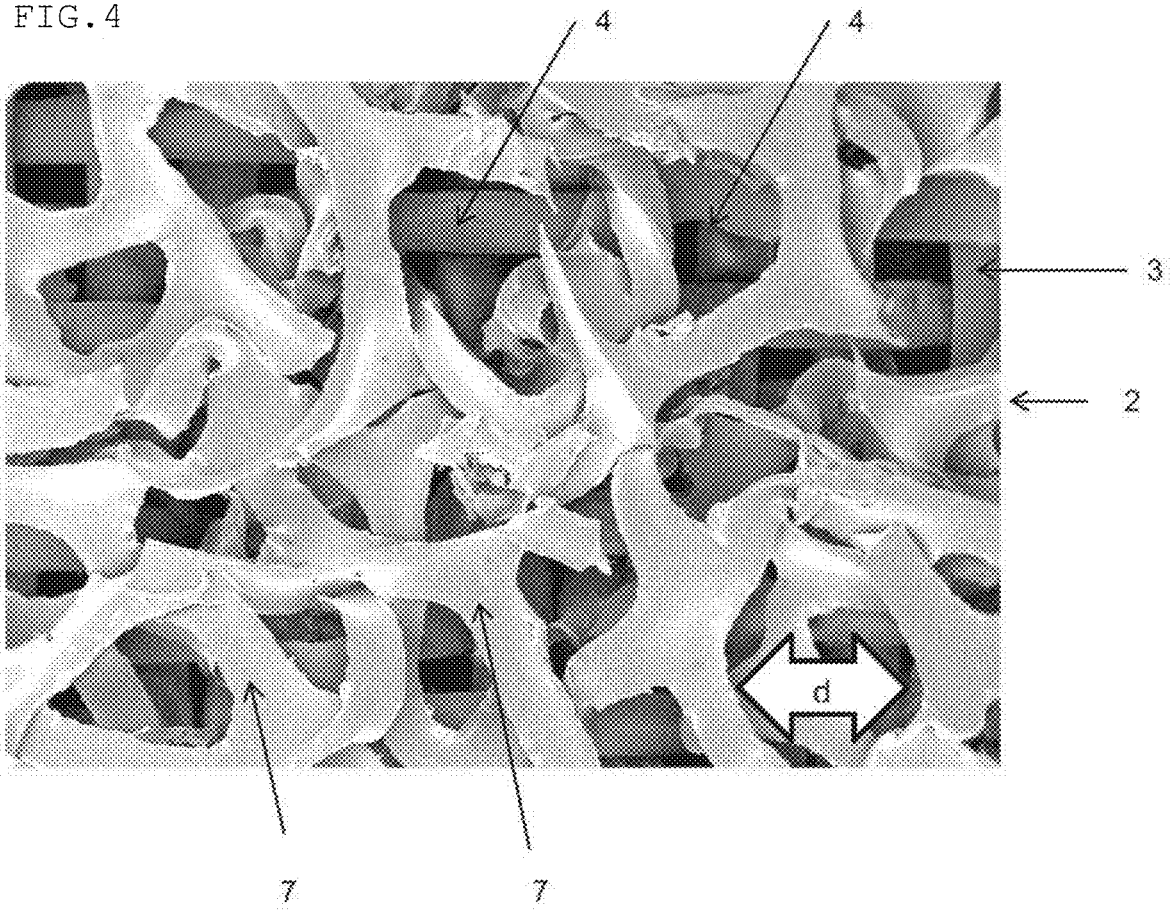
FIG. 4 shows a view of a structured forming belt according to the invention.

FIG. 4 finally shows a heavily enlarged view of a structured forming belt 1 according to the invention. The view is made onto the paper-contacting side of the forming belt 1. The layer of polymer foam 2 can be seen, and the underlying woven fabric 3 of the support structure 3 can be seen through the pores 4. In the process of sheet formation, fibers 6 will be deposited both on the webs 7 of polymer material as well as fully or partially penetrate the pores 4 of the layer of polymer foam. The diameter "d" of such a pore in FIG. 4 is approx. 1 mm. However, in other advantageous forming belts, smaller pores, for example having diameters of 750 μm, 500 μm or less, or else larger pores having diameters of 1.5 mm, 2 mm or more, can also be used. The pore sizes in a structured forming belt will usually have a certain distribution.

The invention claimed is:

1. A method for producing a structured fibrous web or a tissue web, the method comprising the following steps:

providing at least one structured forming belt including a layer of polymer foam providing a paper-contacting side of the at least one structured forming belt, the pores in the layer of polymer foam having a pore density of less than 30 PPI;

bringing a fibrous suspension into contact with the at least one structured forming belt;

using at least one dewatering element or a suction element to dewater the fibrous suspension; and at least partly transferring a structure of the foam layer to the fibrous web.

2. The method according to claim 1, which further comprises carrying out the transferring step by transferring at least part of the structure of the layer of polymer foam to the fibrous web as a pore structure of the layer of polymer foam.

3. The method according to claim 1, which further comprises carrying out the transferring step by transferring at least part of the structure of the layer of polymer foam to the fibrous web as an external structure having been incorporated in the layer of polymer foam.

4. The method according to claim 3, which further comprises incorporating the external structure in the layer of polymer foam by embossing, branding, etching, cutting, or punching.

5. A structured forming belt or clothing for a machine for producing a fibrous web or a tissue web, the structured forming belt comprising:

a paper-contacting side;

a backing side;

a support structure; and at least one layer of polymer foam providing said paper-contacting side being suitable for transferring a structure to the fibrous web, said at least one layer of polymer foam having a pore density of less than 30 PPI.

6. The structured forming belt according to claim 5, wherein said structure is a uniform or non-uniform structure.

7. The structured forming belt according to claim 5, wherein said at least one layer of polymer foam has an embossed, branded, etched, cut, or punched external structure.

8. The structured forming belt according to claim 5, wherein said at least one layer of polymer foam is formed of or includes an elastomer or a polyurethane.

9. The structured forming belt according to claim 5, wherein said at least one layer of polymer foam is formed of or includes polyamide, polyester, or polyethylene.

10. The structured forming belt according to claim 5, wherein said at least one layer of polymer foam has an anisotropic pore structure.

11. The structured forming belt according to claim 5, wherein said at least one layer of polymer foam is adhesively bonded, welded or NIR transmission welded to said support structure.

12. The structured forming belt according to claim 10, wherein compression of the at least one layer of polymer foam results in pores having the anisotropic pore structure that are deformed in a thickness direction of said at least one layer of polymer foam.

13. A machine for producing a fibrous web or a tissue web, the machine comprising at least one structured forming belt according to claim 5.

* * * * *